US005771970A

United States Patent [19]

Jani

[11] Patent Number: 5,771,970

[45] **Date of Patent: *Jun. 30, 1998**

[54] TUBING TIGHTENER

[75] Inventor: William Jani, Calgary, Canada

[73] Assignee: Northwest Tech Group Inc., Alberta, Canada

[ * ] Notice: The term of this patent shall not extend beyond the expiration date of Pat. No. 5,623,991.

[21] Appl. No.: 677,341

[22] Filed: Jul. 2, 1996

Related U.S. Application Data

[63] Continuation-in-part of Ser. No. 568,199, Dec. 6, 1995, Pat. No. 5,623,991.

[30] Foreign Application Priority Data

Nov. 8, 1995 [CA] Canada ..... 2162409

[51] Int. Cl.[6] ..... E21B 23/00

[52] U.S. Cl. ..... 166/216; 166/217

[58] Field of Search ..... 166/117.7, 210, 166/216, 217, 243; 81/443, 448; 294/86.25

[56] References Cited

U.S. PATENT DOCUMENTS

| | | | |
|---|---|---|---|
| 1,617,303 | 2/1927 | Dougherty | 166/117.7 |
| 2,038,262 | 4/1936 | Bernhardt | 81/448 |
| 2,665,888 | 1/1954 | Claypool et al. | 166/117.7 |
| 3,296,900 | 1/1967 | Behnke | 81/448 |
| 3,322,006 | 5/1967 | Brown | 166/117.7 X |
| 3,380,528 | 4/1968 | Timmons | 166/117.7 X |
| 4,499,799 | 2/1985 | Bordages | 81/443 X |
| 5,275,239 | 1/1994 | Obrejanu | 166/210 |
| 5,623,991 | 4/1997 | Jani | 166/216 |
| 5,636,690 | 6/1997 | Garay | 166/216 |

FOREIGN PATENT DOCUMENTS 1274470 9/1990 Canada .

OTHER PUBLICATIONS

Drawing of clutch mandrel for slip assemblies for Homco Reversing Tool, Part No. 622–337 by Gulf Tool Co., Houston, Texas, Jan. 8, 1948, and photograph of same clutch mandrel believed to have been on sale more than one year prior to the filling of the present application.

*Primary Examiner*—Hoang C. Dang
*Attorney, Agent, or Firm*—Van Dyke, Gardner, Linn & Burkhart, LLP

[57] ABSTRACT

A tubing tightener which is readily adaptable to either clockwise or anti-clockwise rotational setting operation and which uses a series of drag slips having integral drag and slip surface regions. The drag surface regions are substantially smooth and are advanced into contact with a wellbore with the slip surface regions retracted, when the tightener is in its unlocked orientation. The slip surface regions are serrated to provide a positive engagement with the wellbore and are advanced into engagement with the wellbore with the drag surface regions retracted, when the tightener is in its locked orientation. The drag slips are caused to rock about a point of contact between the drag slip surfaces and the wellbore, located intermediate the drag and slip surface regions, in order to advance the appropriate surface region of each drag slip into engagement with the wellbore. The invention provides for a compact, lightweight construction with improved reliability and increased bypass around the tightener.

24 Claims, 7 Drawing Sheets

TUBING TIGHTENER

This application is a continuation-in-part of application Ser. No. 08/568,199 filed Dec. 6, 1995, now U.S. Pat. No. 5,623,991.

BACKGROUND OF THE INVENTION

1. Field of the Invention

This invention relates to a tube tightener for downhole use in production and exploration wells.

2. Description of the Prior Art

After a string of tubing is run down a wellbore, it requires to be tightened so that the tubing is securely and centrally located in the bore. It can also happen that the tubing becomes loose after it has been in the well for a length of time, due to the action of downhole pumps or other equipment to which the tightener is attached, which also requires that the tubing string be tightened. A wide variety of tubing anchors have been proposed for this purpose, such anchors using slips which are forced outwardly into gripping engagement with the wellbore once the tubing string is in position. Some devices use a threaded rotation of the tubing string to set the slips but this can be difficult or impossible to release for withdrawal or re-location of the tubing string. Drilling or fishing operations then become necessary to remove the anchor. Other methods use a cone arrangement with a shear system to set the slips, but this often results in shearing of the tool due to the force exerted on the cone. Also, the anchors tends to become contaminated with sand during normal operation in the wellbore and release of the anchor for removal or relocation of the tubing string then becomes difficult or impossible.

One attempt to overcome the foregoing problems is described in Canadian Patent No. 1,274,470 (Weber). Weber's approach is to use slips extending radially outwardly through apertures in a slip casing and biased radially inwardly (i.e. away from the wellbore surface) by means of springs. An inner mandrel is connected for rotation with a tubing string and has on its outer surface a series of cams which can be rotated into engagement with the rear surface of the slips by rotation of the inner mandrel, which forces the slips outwardly against the force of the springs into engagement with the wellbore surface. The rotation of the inner mandrel to set the anchor is effected by rotating the tubing string. The slips have vertically extending teeth which bite into the wellbore surface and lock the anchor in position. In order to restrain the slips from rotating with the inner mandrel during the setting operation, which would prevent the necessary relative movement between the cams and the slips, a drag block casing is secured to the slip casing and is provided with a number of drag blocks, which are biased outwardly by springs into engagement with the wellbore surface. These drag blocks restrain rotational movement but permit vertical movement of the anchor and tubing string.

However, there are a number of drawbacks to the Weber device, which the present invention seeks to overcome. The Weber device is primarily designed for operation with a screw-type pump in which the pump operates by rotating the rod string to the right when viewed from its upper end. Thus, the device is also designed to be set by rotating the inner mandrel to the right (i.e., clockwise) and released by rotating anti-clockwise. However, there are many other situations where the tubing tightener should be manipulated in the opposite direction but the Weber tool does not provide flexibility in that regard. Furthermore, the Weber device is unnecessarily complex and unwieldy in that it employs separate slips and drag blocks. This decreases the bypass around the tool.

It would therefore be desirable to provide a tubing tightener which can easily be adapted to either clockwise or anti-clockwise setting, depending upon user requirements. It would also be desirable that the slips and drag blocks be integrated in order to increase the bypass around the tool and reduce the weight and length of the device, it being noted that increased weight and length can make removal or relocation of the device more difficult.

BROAD SUMMARY OF THE INVENTION

The purpose of the present invention is to provide a mechanism which will permit the tubing to be securely tightened in the wellbore, either during running of the tubing string or for the purpose of tightening the string after it has been in the well for a period of time, and which avoids the problems experienced with conventional tube tighteners described above, including the Weber device. The tube tightener may be used at wellbore locations where either the bore has a casing or is uncased. By very simple disassembly and reassembly before use, the tool can be adapted to either clockwise or anti-clockwise setting. The slips are integrated rather than being separate units, which saves weight and size and provides for greatly enhanced reliability as well as increased bypass.

Thus, according to the invention, there is provided a tubing tightener adapted for insertion in a wellbore together with a tubing string, the tightener comprising:

a mandrel adapted for connection to at least an upper section of tubing by attachment of the mandrel to a lower end of the tubing section, to secure the mandrel for axial and rotational movement with the tubing string and enable the tightener to be rotated between an unlocked and a locked position by manipulation of the tubing string;

a drag slip support assembly mounted upon the mandrel and means for restraining the support assembly from axial movement on the mandrel;

a plurality of drag slips peripherally mounted upon the support assembly, the drag slips each having an outer surface comprising a slip surface region and a drag surface region which are selectively engageable with the wellbore and, located intermediate these regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a booster assembly supported by and rotatable with the mandrel, and including means engaging the respective drag slips upon rotation of the mandrel in a first direction to progressively force the slip surface regions outwardly into engagement with the wellbore with sufficient force to prevent relative movement between the drag slips and the wellbore;

the booster assembly being rotatable with the mandrel in the opposite direction to allow the drag slips to rock about their regions of contact with the wellbore to retract the slip surface regions and advance the drag surface regions under the influence of the biasing means.

Preferably, the booster assembly includes a plurality of formations, each having an outwardly facing wall surface extending tangentially to an arc of rotation of the mandrel and engaging the respective drag slips upon rotation of the mandrel to progressively force the slip surface regions outwardly into engagement with the wellbore.

In one embodiment of the invention, the drag slip support assembly is freely rotatable about the mandrel and each formation comprises a booster sub having side edges extending axially of the mandrel and a wedge profile in cross-section from one side edge to the opposite side edge to form the outwardly facing wall surface. Each booster sub is adapted for selective engagement with a first rear surface region of the drag slip behind the slip surface region upon rotation of the mandrel Upon rotation of the mandrel from the unlocked position of the tightener to its locked position, the outwardly facing wall surface is moved into engagement with the first rear surface region of the drag slip and progressively forces the first rear surface region outwardly to cause the drag slip to rock about the region of contact between the drag slip surface and the wellbore. This action retracts the drag surface region and advances the slip surface region until the slip surface region engages the wellbore with sufficient force to prevent relative movement between the drag slip and the wellbore. Upon rotation of the mandrel from the locked position of the tightener to its unlocked position, the outwardly facing wall surface of each booster sub relieves pressure on the drag slip, which allows the drag slip to rock in the opposite direction under the influence of the biasing means to retract the slip surface region and advance the drag surface region.

In a second, preferred embodiment of the invention, there is provided a tubing tightener adapted for insertion in a wellbore together with a tubing string, the tightener comprising:

a mandrel adapted for connection to at least an upper section of tubing by attachment of the mandrel to a lower end of the tubing section, to secure the mandrel for axial and rotational movement with the tubing string and enable the tightener to be rotated between an unlocked and a locked position by manipulation of the tubing string;

a plurality of drag slips peripherally mounted upon the mandrel, the drag slips each having an outer surface comprising a slip surface region and a drag surface region which are selectively engageable with the wellbore and, located intermediate these regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a booster assembly supporting the drag slips and comprising a pair of spaced elevators rotatably mounted on the mandrel with opposed surfaces between which the drag slips extend;

each drag slip having extensions formed at its opposite ends, which extend into channels formed in the opposed surfaces of the elevators, the channel walls providing outwardly facing wall surfaces extending tangentially to an arc of rotation of the mandrel and engaging the drag slip extensions upon rotation of the mandrel, the extensions being located on the same side of the region of contact between the drag slip surface and the wellbore as the slip surface region, such that exertion of an outward force upon the extensions results in rocking of the drag slips to advance the slip surface regions and retract the drag surface regions.

Preferably, three or more drag slips are employed and the drag surface regions are substantially smooth, whilst the slip surface regions are serrated with teeth extending parallel to the axis of the wellbore. It is also preferred that the outwardly facing wall surfaces have a convex curvature which curves from a tangential orientation at a point of contact with the arc of rotation of the mandrel to become progressively closer to an arcuate orientation centered on said mandrel axis.

The invention will hereinafter be described further by way of example only and by reference to the accompanying drawings.

DESCRIPTION OF THE PREFERRED EMBODIMENTS

Figure 1:
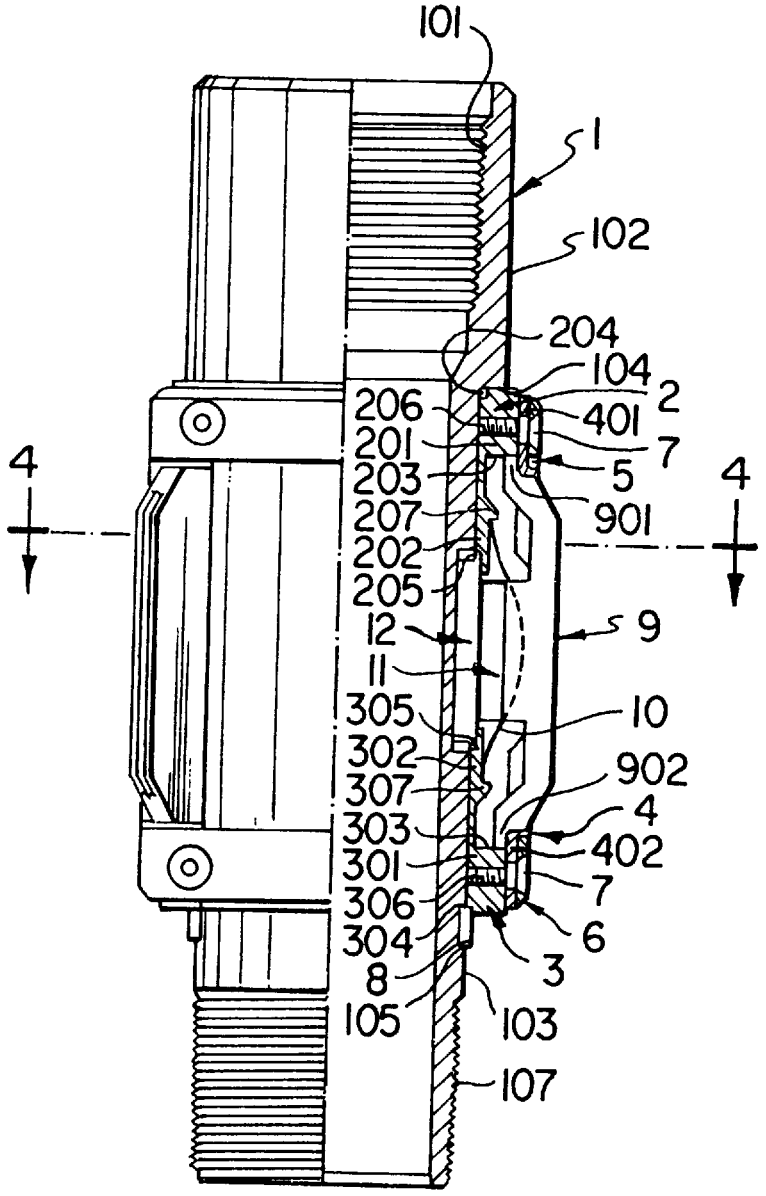
FIG. 1 is a side elevation, partly in cross-section, of a tubing tightener according to a preferred embodiment of the invention.
Figure 2:
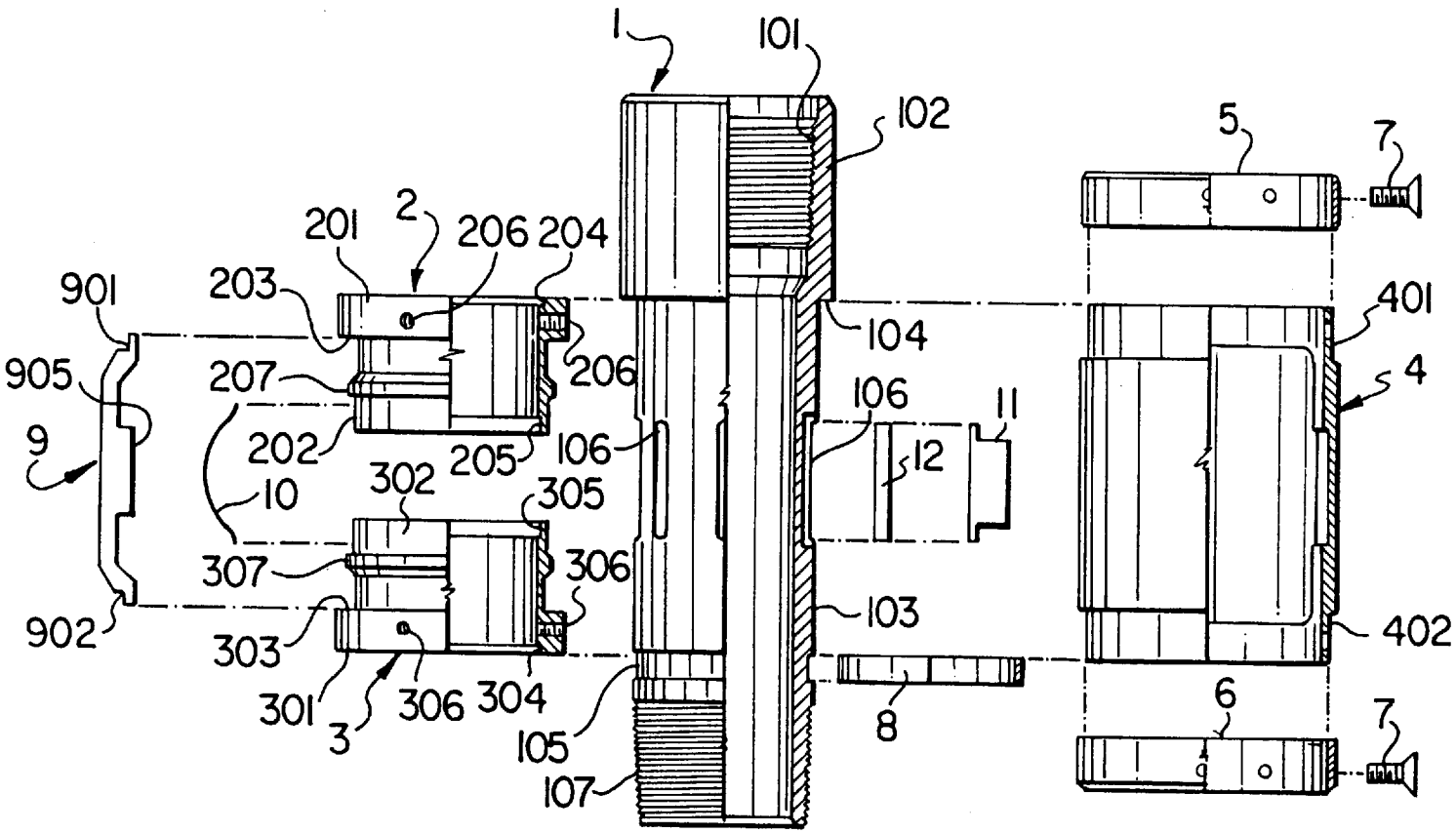
FIG. 2 is an exploded view of the embodiment of FIG. 1.

Turning now to FIGS. 1 and 2 of the drawings, in a first preferred embodiment of the invention, the tubing tightener is located in a tubing string (not shown) by means of a mandrel 1. The mandrel has an upper region 102, provided with female threads 101 which engage with complementary male threads on an upper section of tubing, and a lower region 103 provided with male threads 107 which engage with complementary female threads on a lower section of tubing. The lower region 103 is of reduced external diameter relative to the upper region 102 and is connected to the upper region through a shoulder 104.

A cage assembly is mounted on the mandrel 1 and comprises a combination of first and second sleeves 2 and 3 supporting a cage 4 therebetween and first and second collars 5 and 6 respectively securing the cage 4 to the sleeves 2 and 3.

The first sleeve 2 is slidably and rotably located on the lower region 103 of the mandrel, the sleeve having upper and lower regions 201 and 202, the latter being of reduced external diameter and connected to the upper region through a peripherally extending shoulder 203. Two peripherally extending shoulder regions 204 and 205 are formed internally of the sleeve 2 at its upper and lower ends, respectively, for purposes which will hereinafter become apparent. The second sleeve 3, of identical construction to sleeve 2, is slidably and rotatably located on the region 103 of the mandrel 1, but is inverted so that upper and lower regions 302 and 301 correspond to upper and lower regions 201 and 202 of sleeve 2. Shoulder regions 304 and 305 correspond to regions 204 and 205 of sleeve 2 and shoulder 303 corresponds to shoulder 203.

Extending between sleeves 2 and 3 is the cylindrical cage 4, the end regions 401 and 402 of which fit snugly over the sleeve regions 201 and 301. The external surfaces of end regions 401 and 402 have peripherally extending shoulder regions, which respectively accommodate collars 5 and 6. The cage 4 is secured to the sleeves 2 and 3 by means of set screws 7 which pass radially through collars 5 and 6 and the respective end regions 401 and 402 and engage with threaded radial bores 206 and 306 in the respective sleeve regions 201 and 301. Thus, together with sleeves 2 and 3 and collars 5 and 6, the cage 4 forms a cage assembly which is both slidably and rotatably mounted on the reduced diameter region 103 of the mandrel 1.

The mandrel region 103 has a peripheral groove 105 which receives a ring 8, which axially locates the cage assembly on the mandrel whilst permitting it to freely rotate.

Figure 3:
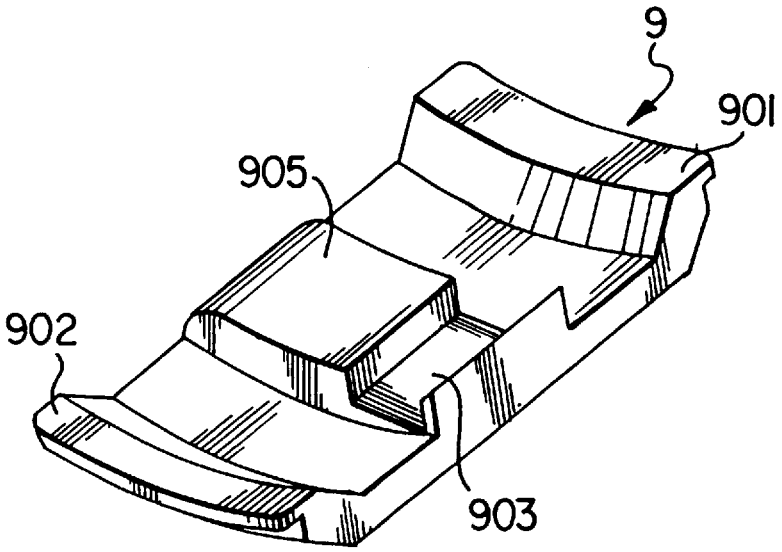
FIG. 3 is a perspective view of a drag slip employed in the embodiment of FIGS. 1 and 2.

The cage 4 has three circumferentially equispaced openings and located within the cage and projecting radially through the respective openings are three identical drag slips 9. Each drag slip is elongated in the vertical direction and arcuate in cross-section and is provided with upper and lower flanges 901 and 902 which abut the inner surface of the cage 4 to limit the extent of outward movement of the drag slips. Each drag slip is urged outwardly by a flat spring 10, which projects into a recess 903 in the rear surface of the drag slip (see FIG. 3) and the ends of which abut the sleeves 2 and 3 and are retained by flanges 207 and 307 formed peripherally about the respective sleeves. Thus, the equidistantly spaced drag slips impose a degree of centering action upon the tubing string as they are urged outwardly against the wellbore.

Figure 4A:
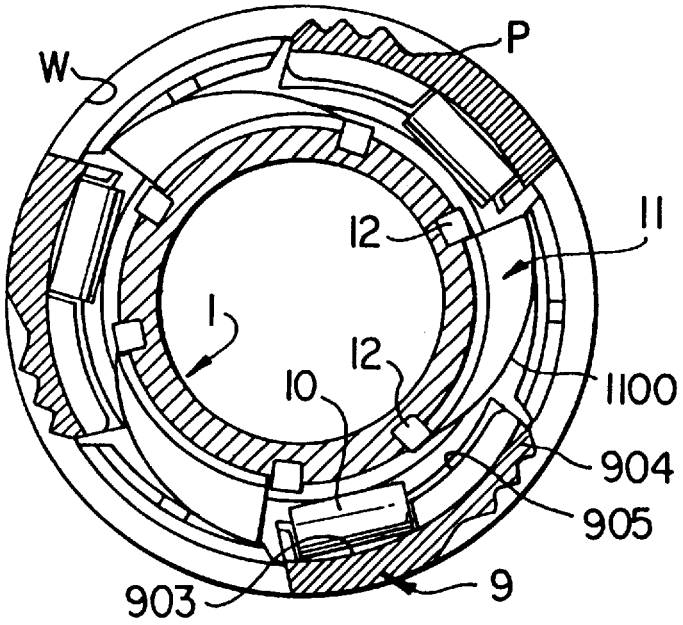
FIGS. 4A and 4B are schematic plan views of the embodiment of FIGS. 1 and 2, showing the positional relationship between the booster subs and the drag slips when the tubing tightener in its unlocked and locked orientations.
Figure 4B:
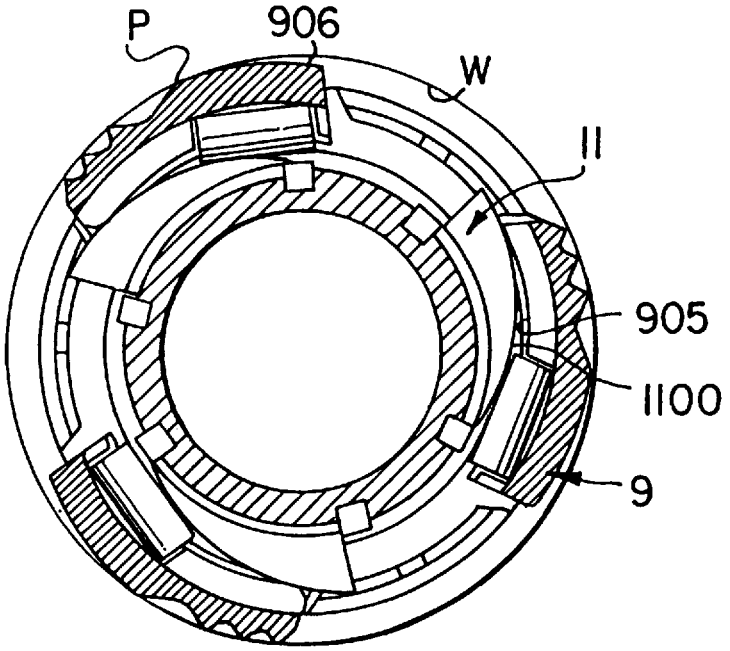
Figure 5:
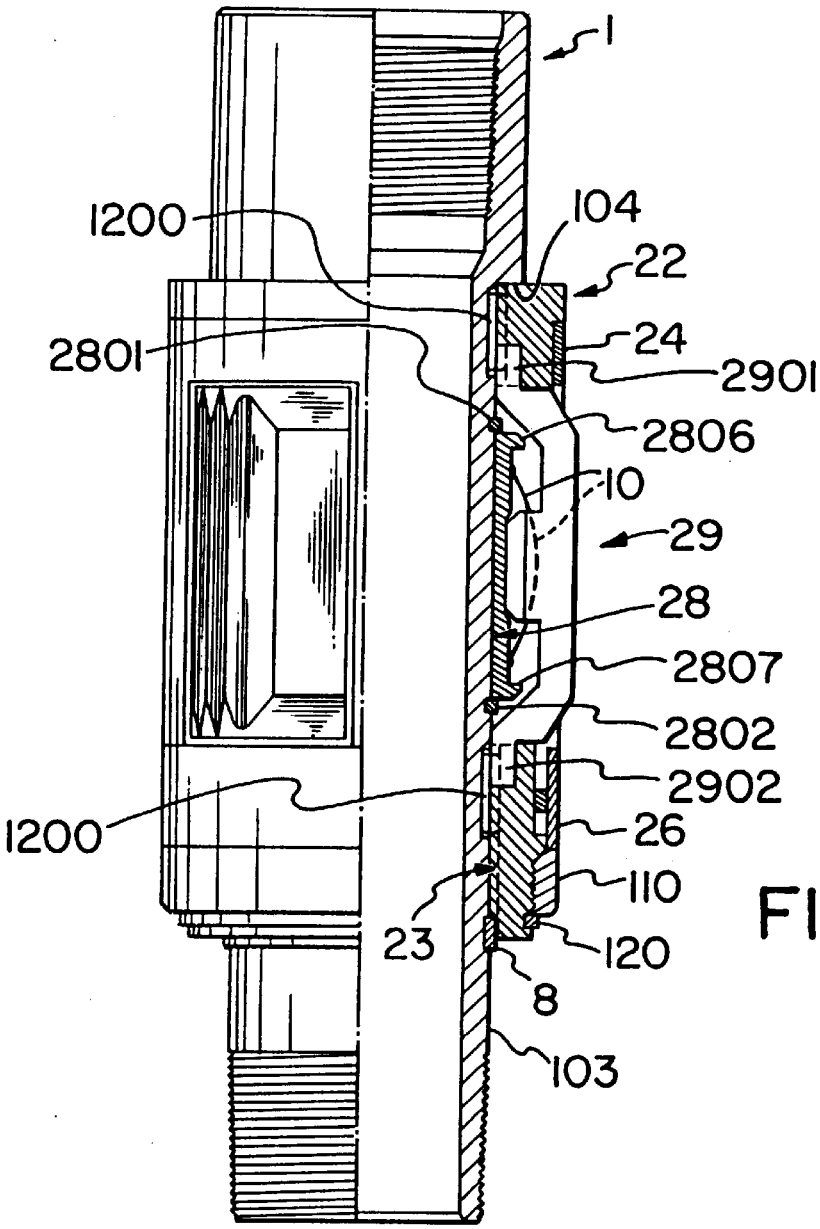
FIG. 5 is a side elevation, partly in cross-section, of a tubing tightener according to a second preferred embodiment of the invention.
Figure 7:
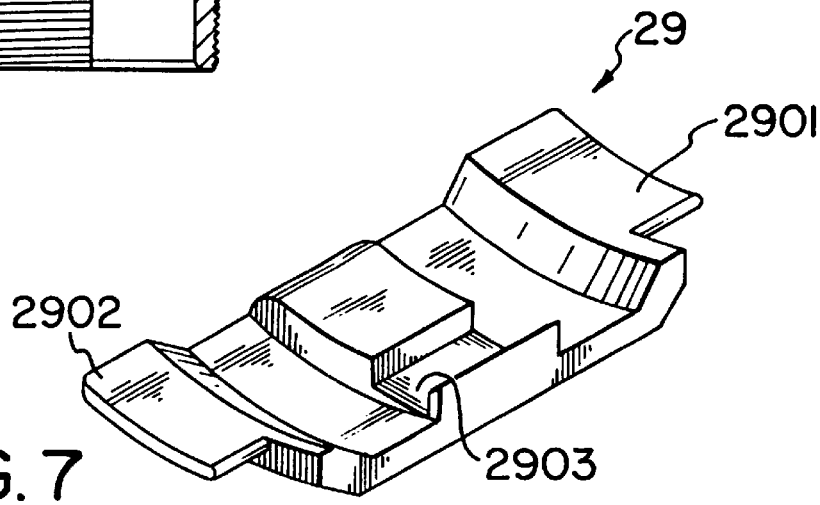
FIG. 7 is a perspective view of a drag slip employed in the embodiment of FIGS. 5 and 6.
Figure 6:
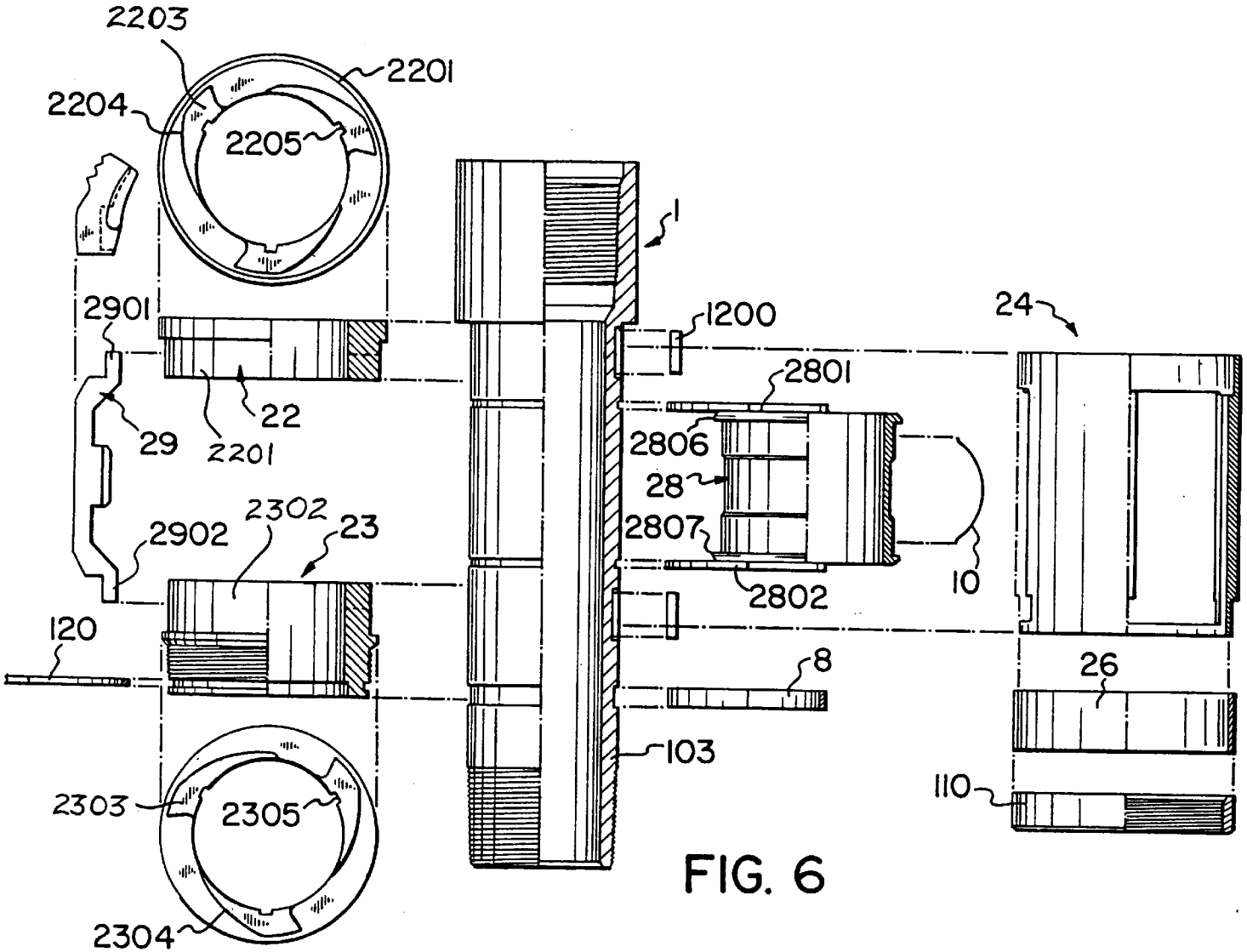
FIG. 6 is an exploded view of the embodiment of FIG. 5.

Referring to FIGS. 4A and 4B, the drag slips are each provided with vertically extending teeth 904 over their slip surface regions. The drag surface region 906 which is biased against the interior surface W of the wellbore by the associated spring 10, however, is substantially smooth. The drag surface region 906 frictionally engages the wellbore and provides control of the tubing string by restraining the drag slips from turning whilst still permitting axial movement of the tubing string. In order to positively force the teeth into engagement with the wellbore and effectively lock the tubing string in place, each drag slip is provided with a booster sub 11 which is both arcuate and wedge shaped in cross-section to provide a ramped surface 1100. The surface 1100 has a convex curvature which curves from a tangential orientation at a point of contact with an arc of rotation of the mandrel to become progressively closer to an arcuate orientation centered on said mandrel axis, as may be seen from FIGS. 4A and 4B. The booster subs are rotationally keyed to the mandrel 1 by means of keys 12 which are located in vertical equispaced slots 106 formed in the mandrel region 103 and extend sufficiently outwardly to engage the side edges of the booster subs. The subs are also held in place by flanges 1101 formed at their upper and lower ends and which are retained within the shoulder regions 205 and 305 of sleeves 2 and 3.

To assemble the tightener for use, the upper sleeve 2 is firstly placed on the lower end of the mandrel 1 and slid up into engagement with the shoulder 104. The keys 12 are then placed in the respective slots 106 and the subs 11 are positioned therebetween with their thin edges facing the direction of rotation selected for setting or locking the tightener. The lower sleeve 3 is then placed on the lower end of the mandrel and slid up the mandrel until the ends of the keys 12 and the flanges 1101 of the booster subs 11 are retained within the shoulder regions 205 and 305 of sleeves 2 and 3. The springs 10 are then placed over the thin edges of the subs 11, with their ends engaging the flanges 207 and 307 of the sleeves 2 and 3. The ring 8 is then placed in position on the mandrel to hold the foregoing sub-assembly in place. The drag slips 9 are loosely placed in the cage 4 with their drag surface regions 906 leading in the clockwise direction and the cage is slid over the sleeves 2 and 3 and manipulated so that the springs 10 become positioned in the recessed rear surface regions 903 of the drag slips. The cage is then secured in place by the collars 5 and 6 and the set screws 7.

In a first rotational position of the tubing string shown in FIG. 4A, each booster sub is positioned with its ramped surface 1100 clear of the drag slip. In this position, the booster subs exert no outward force upon the drag slips and the tubing string can be moved up or down with only the drag imposed by the springs 10 urging the drag surface regions 906 into engagement with the wellbore. To force the teeth 904 into gripping engagement with the wellbore, it is necessary only to turn the tubing string in the appropriate direction (clockwise, in the present embodiment) to the position shown in FIG. 4B. The frictional engagement of the drag surface regions 906 with the wellbore under the outward bias of the springs 10 is sufficient to inhibit rotation of the drag slips and the cage assembly and cause the ramped surfaces 1100 of the booster subs to be moved into engagement with the corresponding rear surface regions 905 of the drag slips, which are directly behind the serrated slip surface region 904. As rotation of the tubing string continues, the ramped surfaces of the booster subs force the surface regions 905 outwardly, which causes each drag slip to rock about a region of contact P between the drag slip surface and the wellbore surface W, located intermediate the drag and slip surface regions. Continued rotation forces the teeth 904 into gripping engagement with the wellbore and the entire assembly, including the tubing string, is then locked in position. To unlock the tightener, it is necessary only to turn the string in the opposite direction, whereby the ramped surfaces 1100 of the booster subs are retracted from engagement with the surface regions 905 and the springs 10 rock the booster subs back into their initial positions with the slip surfaces retracted.

Turning to the embodiment of FIGS. 5–8, wherein like elements to those of the previous embodiment are denoted by like reference numerals, the booster sub assembly in this embodiment comprises a combination of top and bottom elevators 22 and 23, the bottom elevator 23 supporting a cage 24 extending between elevators 22 and 23. A retainer ring 26 surrounds the lower part of the cage and is supported in position by a female-threaded retainer 110 which is screwed on the lower part of the bottom elevator 23. A ring lock 120 prevents the retainer 110 from unscrewing from the bottom elevator 23. The bottom elevator 23 is supported on the mandrel by ring 8.

Analogously to the booster subs 11 of the previous embodiment, the elevators are rotationally keyed to the mandrel 1 by means of keys 1200 which are located in vertical equispaced slots formed in the mandrel region 103 and extend outwardly to engage notches 2205 and 2305 formed in the inner peripheries of the respective elevators 22 and 23. Rotatably mounted upon the mandrel 1 is a sleeve 28, which is freely rotatable upon the mandrel but axially located by ring locks 2801 and 2802 located in peripheral grooves in the mandrel. The sleeve 28 is provided with annular flanges 2806 and 2807 at its upper and lower extremities respectively.

The cage 24 has three circumferentially equispaced openings and located within the cage and projecting radially through the respective openings are three identical drag slips 29. Each drag slip is elongated in the vertical direction and arcuate in cross-section and is provided with upper and lower extensions 2901 and 2902, for a purpose which will be explained hereinafter. Each drag slip is urged outwardly by a flat spring 10, which projects into a recess 2903 in the rear surface of the drag slip (see FIG. 7) and the ends of which abut the sub 28.

Figure 8A:
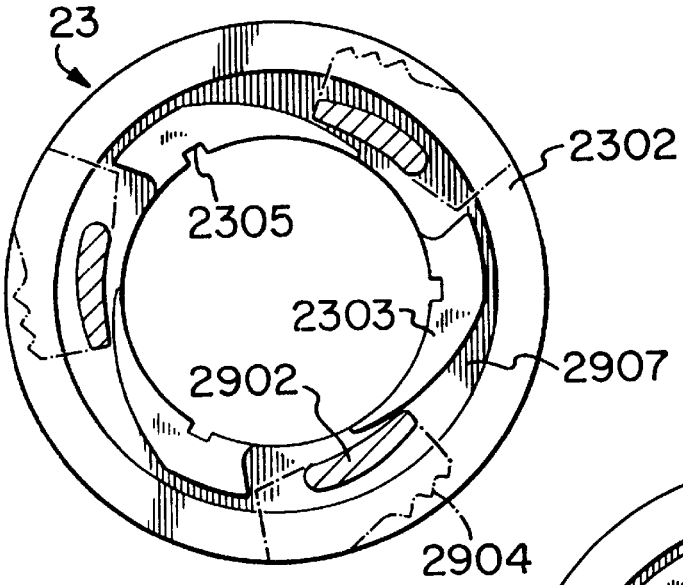
FIGS. 8A, 8B and 8C are schematic plan views of the embodiment of FIGS. 5 and 6, showing the positional relationship between the elevators and the drag slip extensions when the tubing tightener in its unlocked and locked orientations.
Figure 8B:
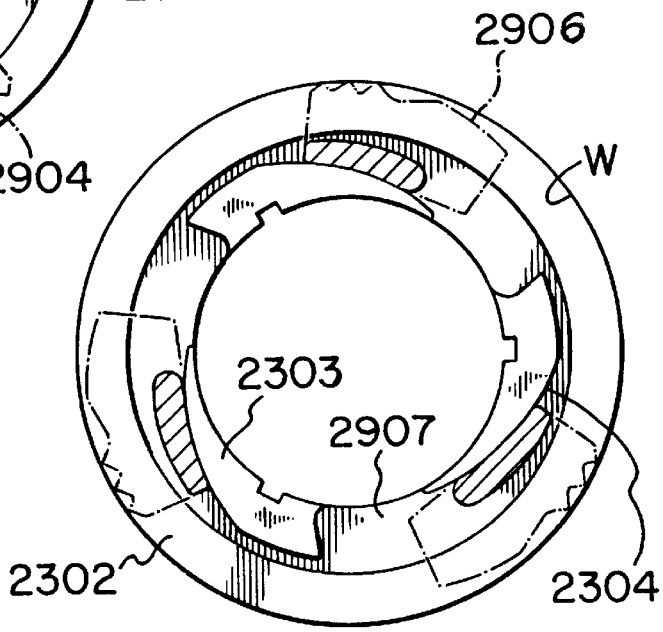
Figure 8C:
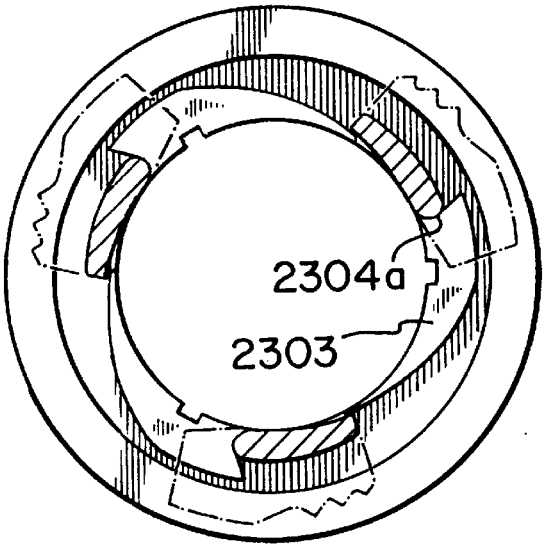

Referring to FIGS. 8A, 8B and 8C, as in the previous embodiment, the drag slips are each provided with vertically extending teeth 2904 over their slip surface regions. The drag surface region 2906 which is biased against the interior surface W of the wellbore by the associated spring 10, however, is substantially smooth. The drag surface region 2906 frictionally engages the wellbore and provides control of the tubing string by restraining the drag slips from turning whilst still permitting axial movement of the tubing string.

The mechanism by which the teeth are positively forced into engagement with the wellbore to effectively lock the tubing string in place will now be described with particular reference to FIGS. 8A, 8B and 8C. In place of the booster subs 11 of the previous embodiment, each drag slip is provided with arcuate upper and lower extensions 2901 and 2902. The lower surface of elevator 22 is formed with a downwardly extending circumferential flange 2201 and the upper surface of elevator 23 is formed with an upwardly extending circumferential flange 2302. Also, the lower surface of elevator 22 and the upper surface of elevator 23 are each provided with three equispaced wedge shaped ridges 2203, 2303 which, in combination with the surounding flange 2201 or 2302, form a continuous channel 2907 on the surface of each elevator. The outwardly facing wall regions 2204, 2304 of the ridges 2203, 2303 are tangential to an arc of rotation of the mandrel, as may be seen in the drawings. The outwardly facing wall surfaces 2204,2304 each have a convex curvature which curves from a tangential orientation at a point of contact with the arc of rotation of the mandrel to become progressively closer to an arcuate orientation centered on the mandrel axis The arcuate upper and lower extensions 2901 and 2902 respectively extend into channels 2907 and, as the elevators are turned clockwise into the orientation of FIG. 8B, the walls 2204, 2304 of the ridges engage the respective extensions 2901 and 2902 and force the extensions outwardly and hence the teeth 2904 of the slip regions of the drag slips into engagement with the wellbore. Turning the elevators back in the counterclockwise direction to the position of FIG. 8A removes the outward pressure on the extensions and allows the springs 10 to urge the drag surface regions 2906 outwardly and retract the teeth 2904 of the slip surface regions, as in the previous embodiment. FIG. 8C illustrates a third possible position of the drag slips. This is enabled by the provision of end walls as indicated at 2304*a* in FIG. 8C, which are co extensive with the outwardly facing wall surfaces 2204, 2304 and which move into engagement with the extensions as the elevators are turned further into the unlocked position of the tightener. These end walls are angled rearwardly and inwardly relative to the direction of turning of the elevators to force the extensions inwardly upon continued turning of the elevators and retract both the slip surface regions and the drag surface regions from engagement with the wellbore. This relieves the pressure of the drag surfaces against the wellbore and assists in retrieval of the tubing string when required.

To assemble the tightener for use, the keys 1200 are firstly inserted into their respective slots in the mandrel. The upper elevator 22 is then placed on the lower end of the mandrel 1 and slid upwardly with the notches 2205 aligned and engaged with the keys 1200 as the elevator is moved into engagement with the shoulder 104. The ring lock 2801 is then placed in position in its groove in the mandrel and sleeve 28 is then placed on the lower end of the mandrel 1 and slid upwardly until it abuts the ring lock 2801. The lower ring lock 2802 is then placed in position in its groove in the mandrel, whereby the sleeve 28 is axially restrained by the upper and lower ring locks but is still freely rotatable. The springs 10 are then placed on the sleeve 28 and equidistantly spaced therearound with their ends engaging the flanges 2806 and 2807 of the sleeve 28. The drag slips 29 are loosely placed in the cage 24 with their drag surface regions 2906 leading in the clockwise direction and the cage is slid over the elevator 22 and manipulated so that the springs 10 become positioned in the recessed rear surface regions 2903 of the drag slips. The drag slips are also manipulated so that their arcuate upper extensions 2901 extend into the channel in the lower surface of elevator 22. The lower keys 1200 are then inserted into their respective slots in the mandrel and the lower elevator 23 is placed on the lower end of the mandrel 1 and slid upwardly with the notches 2305 in the elevator being aligned and engaged with the keys 1200 as the channel in the upper face of the elevator 23 is moved into engagement with the arcuate lower extensions 2902 of the drag slips. The elevator support ring 8 is then located in position. The retainer ring 26 is then placed over the elevator 23 and slid up into abutment with the cage 24 and the threaded retainer 110 is screwed onto elevator to support the ring 26 and, consequently, the cage 24. Finally, the ring lock 120 is installed.

In this embodiment, the tightener is again set by rotating the tubing string clockwise. In order to reverse the direction, it is a simple matter to dissasemble the tightener in the reverse order of the above assembly procedure, invert the drag slips so that they face in the opposite direction, replace the elevators 22 and 23 by mirror image elevators so that the channels extend in the opposite direction, and reassemble. The tightener is now set by turning the tubing string in the anti-clockwise direction.

Thus, it will be apparent that by combining the drag blocks and the slips into integrally formed drag slips, and designing the drag slips, the cage and the booster subs for easy disassembly and reassembly with the components oriented in the opposite direction of operation, considerable advantages in terms of lower cost, weight and bulk and also flexibility of operation are realized.

Modifications and improvements to the preferred forms of the invention disclosed and described herein may occur to those skilled in the art, without departing from the spirit and scope of the invention which are limited only by the appended claims.

What is claimed is:

1. A tubing tightener adapted for insertion in a wellbore together with a tubing string, the tightener comprising:

a mandrel adapted for connection to at least an upper section of tubing by attachment of the mandrel to a lower end of the tubing section, to secure the mandrel for axial and rotational movement with the tubing string and enable the tightener to be rotated between an unlocked and locked position by manipulation of the tubing string;

a drag slip support assembly mounted upon the mandrel and means for restraining said support assembly from axial movement on said mandrel;

a plurality of drag slips peripherally mounted upon the support assembly, the drag slips each having an outer surface comprising a slip surface region and a drag surface region which are selectively engageable with the wellbore and, located intermediate said regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a booster assembly supported by and rotatable with the mandrel, and including a plurality of formations, each having an outwardly facing wall surface extending tangentially to an arc of rotation of the mandrel and engaging the respective drag slips upon rotation of the mandrel in a first direction to progressively force the slip surface regions outwardly into engagement with the wellbore with sufficient force to prevent relative movement between the drag slips and the wellbore;

the booster assembly being rotatable with the mandrel in the opposite direction to allow the drag slips to rock about their regions of contact with the wellbore to retract the slip surface regions and advance the drag surface regions under the influence of the biasing means.

2. A tubing tightener as defined in claim 1, wherein each said outwardly facing wall surface has a convex curvature which curves from a tangential orientation at a point of contact with said arc of rotation of said mandrel to become progressively closer to an arcuate orientation centered on said mandrel axis.

3. A tubing tightener as defined in claim 2, wherein:

said drag slip support assembly is freely rotatable about said mandrel and each said formation comprises a booster sub having side edges extending axially of the mandrel and a wedge profile in cross-section from one side edge to the opposite side edge to form said outwardly facing wall surface, each said booster sub adapted for selective engagement with a first rear surface region of the drag slip behind the slip surface region upon rotation of said mandrel;

each booster sub being rotatable with the mandrel upon rotation thereof from the unlocked position of the tightener to its locked position whereupon said outwardly facing wall surface is moved into engagement with said first rear surface region of the drag slip and progressively forces said first rear surface region outwardly to cause the drag slip to rock about the region of contact between the drag slip surface and the wellbore to retract the drag surface region and advance the slip surface region until the slip surface region engages the wellbore with sufficient force to prevent relative movement between the drag slip and the wellbore; and each booster sub being rotatable with the mandrel upon rotation thereof from the locked position of the tightener to its unlocked position to disengage the outwardly facing wall surface from the drag slip to allow the drag slip to rock in the opposite direction under the influence of said biasing means to retract the slip surface region and advance the drag surface region.

4. A tubing tightener as defined in claim 3 comprising at least three said drag slips.

5. A tubing tightener as defined in claim 4, wherein each said slip surface region is provided with teeth extending in the axial direction of said wellbore for gripping said wellbore.

6. A tubing tightener as defined in claim 5, wherein each said drag slip has a second rear surface region located behind said drag surface region, said second rear surface region engaged by said biasing means.

7. A tubing tightener as defined in claim 6, wherein said booster assembly is in the form of a cylindrical cage assembly having a series of peripherally spaced openings through which said drag slips project radially outwardly.

8. A tubing tightener as defined in claim 7, wherein said cage assembly comprises upper and lower sleeve members rotatably mounted on said mandrel and a cage member secured to said sleeve members and extending therebetween.

9. A tubing tightener as defined in claim 8, wherein:

said upper sleeve member comprises upper and lower sleeve sections, said lower section extending downwardly inside said cage member, and said lower sleeve member comprises upper and lower sleeve sections, said upper section extending upwardly inside said cage member, said upper section of said lower sleeve member and said lower section of said upper sleeve member each being provided with an outwardly extending peripheral flange; and said biasing means for each said drag slip comprises a flat spring having ends thereof captured between said flanges and a central region bowed outwardly into abutment with said drag slip second rear surface region.

10. A tubing tightener as defined in claim 9, wherein:

each said drag slip has upper and lower ends respectively provided with arcuate flanges which extend upwardly and downwardly behind upper and lower edges of the cage openings, respectively, and prevent separation of said drag slip from said cage.

11. A tubing tightener as defined in claim 10, wherein:

each said booster sub is keyed for rotation with said mandrel by means of key members projecting outwardly from axially extending slots in said mandrel and retaining therebetween said side edges of said booster sub.

12. A tubing tightener as defined in claim 11, wherein:

said drag slips and said booster sub co-operate for locking said tightener in a first selected direction of rotation of said tubing string;

said cage member is removably secured to said sleeve members; and said booster subs are removable from said mandrel and said drag slips are removable from said cage assembly, upon detachment of said cage member from said sleeve members, and are reversible to permit reattachment of said cage member to said sleeve members with said drag slips and said booster subs co-operating to lock said tightener upon rotation of said tubing string in the opposite direction.

13. A tubing tightener as defined in claim 2 comprising at least three of said drag slips.

14. A tubing tightener as defined in claim 1 comprising at least three of said drag slips.

15. A tubing tightener adapted for insertion in a wellbore together with a tubing string, the tightener comprising:

a mandrel adapted for connection to at least an upper section of tubing by attachment of the mandrel to a lower end of the tubing section, to secure the mandrel for axial and rotational movement with the tubing string and enable the tightener to be rotated between an unlocked and a locked position by manipulation of the tubing string;

a plurality of drag slips peripherally mounted upon said mandrel, the drag slips each having an outer surface comprising a slip surface region and a drag surface region which are selectively engageable with the wellbore and, located intermediate said regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a booster assembly supporting said drag slips and comprising a pair of spaced elevators rotatably mounted on said mandrel with opposed surfaces between which said drag slips extend;

each drag slip having extensions formed at its opposite ends, which extend into channels formed in the opposed surfaces of the elevators, the channel walls providing outwardly facing wall surfaces extending tangentially to an arc of rotation of said mandrel and engaging the drag slip extensions upon rotation of the mandrel, the extensions being located on the same side of the region of contact between the drag slip surface and the wellbore as the slip surface region, such that exertion of an outward force upon the extensions results in rocking of the drag slips to advance the slip surface regions and retract the drag surface regions;

whereby rotation of the mandrel from the unlocked position of the tightener to its locked position moves said outwardly facing wall surfaces into engagement with said drag slip extensions and progressively forces said extensions outwardly to cause each drag slip to rock about the region of contact between the drag slip surface and the wellbore to retract the drag surface region and advance the slip surface region until the slip surface region engages the wellbore with sufficient force to prevent relative movement between the drag slip and the wellbore; and rotation of the mandrel from the locked position of the tightener to its unlocked position allows the drag slip to rock in the opposite direction under the influence of said biasing means to retract the slip surface region and advance the drag surface region.

16. A tubing tightener as defined in claim 15, wherein each said outwardly facing wall surface has a convex curvature which curves from a tangential orientation at a point of contact with said arc of rotation of said mandrel to become progressively closer to an arcuate orientation centered on said mandrel axis.

17. A tubing tightener as defined in claim 16, wherein:

the outwardly facing wall surfaces of said channels are coextensive with end walls which move into engagement with said extensions as the elevators are turned into the unlocked position of the tubing tightener, said end walls being angled rearwardly and inwardly relative to the direction of turning of said elevators to force said extensions inwardly upon continued turning of the elevators and retract both said slip surface regions and said drag surface regions from engagement with said wellbore.

18. A tubing tightener as defined in claim 15, 16, or 17, comprising at least three said drag slips equispaced upon said booster assembly in circular array.

19. A tubing tightener as defined in claim 18, wherein each said slip surface region is provided with teeth extending in the axial direction of said wellbore for gripping said wellbore.

20. A tubing tightener as defined in claim 19, wherein each said drag slip has a second rear surface region located behind said drag surface region, said second rear surface region engaged by said biasing means.

21. A tubing tightener as defined in claim 20, wherein said booster assembly is in the form of a cylindrical cage assembly having a series of peripherally spaced openings through which said drag slips project radially outwardly, said cage assembly extending between and freely rotatable relative to said elevators.

22. A tubing tightener as defined in claim 21, further comprising a central sleeve member rotatably mounted on said mandrel between said elevators.

23. A tubing tightener as defined in claim 22, wherein:

said biasing means for each said drag slip comprises a flat spring having ends thereof in abutment with said sleeve member and a central region bowed outwardly into abutment with said drag slip second rear surface region.

24. A tubing tightener as defined in claim 23, wherein:

each said elevator is keyed for rotation with said mandrel by means of key members projecting outwardly from axially extending slots in said mandrel and engaging slots formed in each said elevator.

* * * * *

UNITED STATES PATENT AND TRADEMARK OFFICE

CERTIFICATE OF CORRECTION

PATENT NO. : 5,771,970
DATED : June 30, 1998
INVENTOR(S) : William Jani

It is certified that error appears in the above-identified patent and that said Letters Patent is hereby corrected as shown below:

Column 10,
Line 53, "booster sub" should be -- booster subs --.

Signed and Sealed this

Fourth Day of February, 2003

JAMES E. ROGAN
*Director of the United States Patent and Trademark Office*